US007997879B2

(12) United States Patent
Bergmann

(10) Patent No.: US 7,997,879 B2
(45) Date of Patent: Aug. 16, 2011

(54) AXIAL PISTON MACHINE OF SWASH-PLATE CONSTRUCTION WITH A BEARING ARRANGEMENT OF THE CYLINDER BLOCK ON A SUPPORTING JOURNAL

(75) Inventor: Martin Bergmann, Schaafheim (DE)

(73) Assignee: Linde Material Handling GmbH (DE)

( * ) Notice: Subject to any disclaimer, the term of this patent is extended or adjusted under 35 U.S.C. 154(b) by 1099 days.

(21) Appl. No.: 11/429,642

(22) Filed: May 5, 2006

(65) Prior Publication Data

US 2006/0275149 A1 Dec. 7, 2006

(30) Foreign Application Priority Data

May 6, 2005 (DE) ..... 10 2005 021 029

(51) Int. Cl.
*F04B 1/12* (2006.01)
*F04B 27/08* (2006.01)

(52) U.S. Cl. ..... 417/269; 417/271; 92/71; 91/499

(58) Field of Classification Search ..... 417/269–271; 91/499–500; 92/71
See application file for complete search history.

(56) References Cited

U.S. PATENT DOCUMENTS 4,602,554 A * 7/1986 Wagenseil et al. ..... 91/486
4,605,358 A * 8/1986 Burandt ..... 417/236
4,615,257 A * 10/1986 Valentin ..... 91/499
4,771,676 A * 9/1988 Matsumoto et al. ..... 92/57
5,800,134 A * 9/1998 Hasegawa et al. ..... 417/269
5,957,666 A * 9/1999 Lee ..... 417/269
6,092,457 A * 7/2000 Inoue et al. ..... 92/129
6,287,086 B1 * 9/2001 Steen ..... 417/269
6,406,271 B1 * 6/2002 Valentin ..... 417/269
7,201,566 B2 * 4/2007 Casar et al. ..... 417/269
7,470,116 B2 * 12/2008 Dantlgraber ..... 417/269

FOREIGN PATENT DOCUMENTS

DE 43 40 061 A1 6/1995
DE 100 55 753 A1 5/2001
GB 2 192 672 A 1/1988

* cited by examiner

*Primary Examiner* — Charles G Freay
*Assistant Examiner* — Christopher Bobish
(74) *Attorney, Agent, or Firm* — The Webb Law Firm

(57) ABSTRACT

An axial piston machine of swash-plate construction includes a cylinder block (2) rotatable in a housing (1) and supported in the axial direction against a valve plate (6*a*) arranged on a housing component (7), a driving shaft (8) coupled in a rotationally synchronous manner to the cylinder block (2), and a cylinder block bearing (10) absorbing transverse forces. In order to achieve a simple construction which is axially and radially compact, the cylinder block bearing (10) is arranged between a central recess (9) of the cylinder block (2) and a supporting journal (7*a*) fastened to the housing component (7) and extending into the recess (9).

14 Claims, 5 Drawing Sheets

AXIAL PISTON MACHINE OF SWASH-PLATE CONSTRUCTION WITH A BEARING ARRANGEMENT OF THE CYLINDER BLOCK ON A SUPPORTING JOURNAL

CROSS-REFERENCE TO RELATED APPLICATION

This application claims priority to German Application No. 10 2005 021 029.5, filed May 6, 2005, herein incorporated by reference in its entirety.

BACKGROUND OF THE INVENTION

1. Field of the Invention

The invention relates to an axial piston machine of swash-plate type construction having a cylinder block that is rotatable in a housing and is supported in the axial direction against a valve plate arranged on a housing component, a driving shaft coupled in a rotationally synchronous manner to the cylinder block, and a cylinder block bearing absorbing transverse forces.

2. Technical Considerations

An axial piston machine of the generic type has been disclosed by DE 100 55 753 A1, herein incorporated by reference. In this axial piston machine, the cylinder block has an "outer bearing arrangement". In this machine, the cylinder block is mounted directly. For this purpose, a cylinder block bearing is arranged radially between the outer surface of the cylinder block and an inner surface of the surrounding housing. The axial piston machine of the generic type is of very short construction in the axial direction but requires a certain minimum diameter on account of the cylinder block bearing sitting on the cylinder block.

Axial piston machines having an "inner bearing arrangement" are also known. In this case, the cylinder block is mounted indirectly. The cylinder block is supported on a rotating driving shaft mounted on both sides in the housing. The rotationally rigid connection between the cylinder block and the driving shaft is affected by a shaft tooth system and a mating tooth system in a cylinder block neck integrally formed on the cylinder block. These tooth systems permit both axial mobility of the cylinder block and limited angular adjustability. As a result, the cylinder block can be adapted in its position to the valve plate. However, the conventional design with an indirect bearing arrangement is of relatively long construction in the axial direction.

Therefore, it is an object of the present invention to provide an axial piston machine of the general type mentioned above but which has a simple construction and is axially as well as radially compact.

SUMMARY OF THE INVENTION

This object is achieved according to the invention in that the cylinder block bearing is arranged between a central recess of the cylinder block and a supporting journal fastened to the housing component and extending into the recess.

One aspect of the invention includes directly mounting the cylinder block but arranging the cylinder block bearing required for this on the inside, such as on a journal of the housing component provided with the valve plate.

Therefore, no space is required outside the cylinder block for the cylinder block bearing. The transverse forces of the driving unit are directed into the journal, and the driving shaft merely needs to transmit torques and therefore only requires a relatively small diameter. In addition, the tooth forces in the region of a driving tooth system between the cylinder block and the driving shaft are also reduced. Materials which have lower strength and can therefore be machined more easily and more cost-effectively can, therefore, be used for the cylinder block and/or the driving shaft.

According to an advantageous configuration of the invention, the supporting journal is integrally formed in one piece on the housing component. The supporting journal is, therefore, a projecting part of the housing component and can be produced in a single operation together with the housing component. Nonetheless, it is also possible to first of all produce the supporting journal separately from the housing component and to then connect it to the latter in a suitable manner, for example by press fitting, by friction welding, by pressure welding, or by other conventional joining processes.

It proves to be favorable if the cylinder block bearing is designed as a movable bearing, such as a roller bearing. As a result, the cylinder block can move in the axial direction and good tightness can be achieved in the region of the valve plate. As an alternative to a roller bearing, other types of conventional rolling-contact bearings may also be used, e.g., ball bearings or self-aligning roller bearings. Furthermore, it is possible to use a plain bearing instead of a rolling-contact bearing.

In an advantageous development of the invention, pistons supported on a swash plate are longitudinally movable in the cylinder block. The cylinder block bearing is arranged axially between a plane containing the piston outlet openings and the valve plate, with an axial offset being formed between the resulting piston transverse force and the bearing force acting in opposition thereto in the cylinder block bearing.

As a result, a larger cylinder block bearing can be used since the cylinder block bearing does not project into the region of the cylinder block neck, in which the rotationally rigid driving of the driving shaft is affected. Furthermore, the cylinder block neck can be designed to be smaller, which leads to higher strength of the cylinder block and to simplified production. Finally, the length of the supporting journal on which the cylinder block bearing is located can also be shortened, so that the bending load of the supporting journal is reduced.

In this configuration of the invention, a tilting moment acting on the cylinder block is produced by the axial offset present between the resulting piston transverse force and the bearing force. In order to prevent the cylinder block from being tipped away from the valve plate, it is advantageous in this connection if apertures are provided in the valve plate. These apertures build up an asymmetrical pressure zone which acts on the cylinder block and is effective in opposition to the tilting moment which is produced by the axial offset between the resulting piston transverse force and the bearing force. Such compensation for tilting moment is known, per se, namely from DE 43 40 061 A1, herein incorporated by reference.

Provided the driving shaft is designed as a stub shaft, on which a sun gear of an epicyclic gear unit driven by the axial piston machine is arranged or integrally formed, radial mobility of the sun gear is obtained since only torques, that is to say transverse or axial forces, are absorbed by the driving shaft. Tolerances and deformations occurring inside the epicyclic gear unit can, therefore, be compensated for by movements of the sun gear.

According to another advantageous configuration of the invention, it is proposed that a valve plate for a second, e.g., coaxially arranged, axial piston machine of swash-plate type of construction be provided on that side of the housing component, which is remote from the supporting journal. A cylinder block bearing can be arranged in the second axial piston machine radially between a central recess of a cylinder block and a second supporting journal, which is fastened to the housing component and is adjacent or coaxial to a driving shaft. This provides a driving unit which has an output on both sides and is suitable, for example, for installation in a drive axle. The two driving units are preferably arranged coaxially to one another. However, an axially offset arrangement is also possible.

Use of the axial piston machine according to the invention as a wheel drive is especially favorable, since the advantages resulting from the compact type of construction can be used in this case.

BRIEF DESCRIPTION OF THE DRAWINGS

Additional advantages and details of the invention are described in greater detail below with reference to the exemplary embodiment that is illustrated in the accompanying schematic figures, in which like reference numbers identify like parts throughout.

DESCRIPTION OF THE PREFERRED EMBODIMENTS

Figure 1:
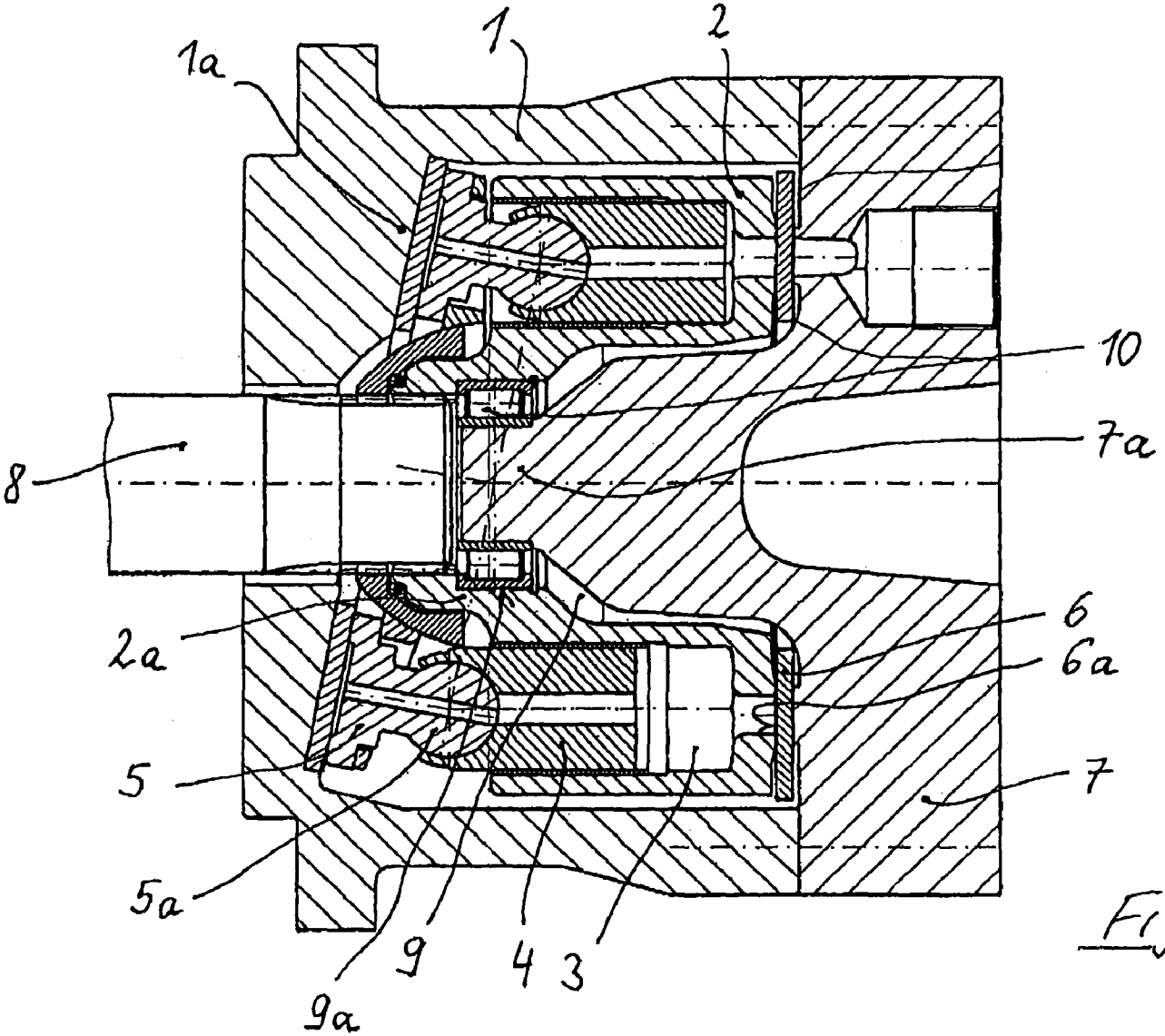
FIG. 1 shows a longitudinal section through an axial piston machine according to the invention.

The axial piston machine according to the invention and shown in FIG. 1 has a housing 1 in which a cylinder block 2 is arranged. This cylinder block 2 is provided with a plurality of concentric cylinder bores 3 in which a respective piston 4 is longitudinally displaceable. Each piston 4 is supported directly or indirectly (not shown here) on a swash plate 1*a* via a sliding shoe 5, on which a sliding-shoe joint 5*a* is integrally formed.

In the present exemplary embodiment, the swash plate 1*a* is integrally formed on the housing 1, since the axial piston machine has a constant displacement volume per revolution. It is, of course, also possible to design the swash plate to be adjustable so that the displacement volume is variable during operation.

The cylinder block 2 is supported axially against a valve plate 6*a*, which is formed on a disc-shaped valve plate body 6. The valve plate body 6 is held on a housing component 7 connected to the housing 1 and designed as a cap. Integrally formed on the cylinder block 2 is a cylinder block neck 2*a*, which has a driving tooth system for a driving shaft 8 which is led out of the housing 1 in the region of the swash plate 1*a*. The driving shaft 8 is designed as a stub shaft with respect to the axial piston machine and has no separate bearing arrangement in the housing 1.

Integrally formed on the housing component 7 coaxially to the stub shaft 8 is a supporting journal 7*a*, which extends into a central recess 9 of the cylinder block 2. Arranged radially between a bore section 9*a* of the central recess 9 and the supporting journal 7*a* is a cylinder block bearing 10, which, in the present exemplary embodiment, is designed as a roller bearing and is located in the region of the cylinder block neck 2*a* and by means of which the transverse forces of the driving unit are directed from the cylinder block 2 into the supporting journal 7*a* and, thus, into the housing component 7.

Figure 2:
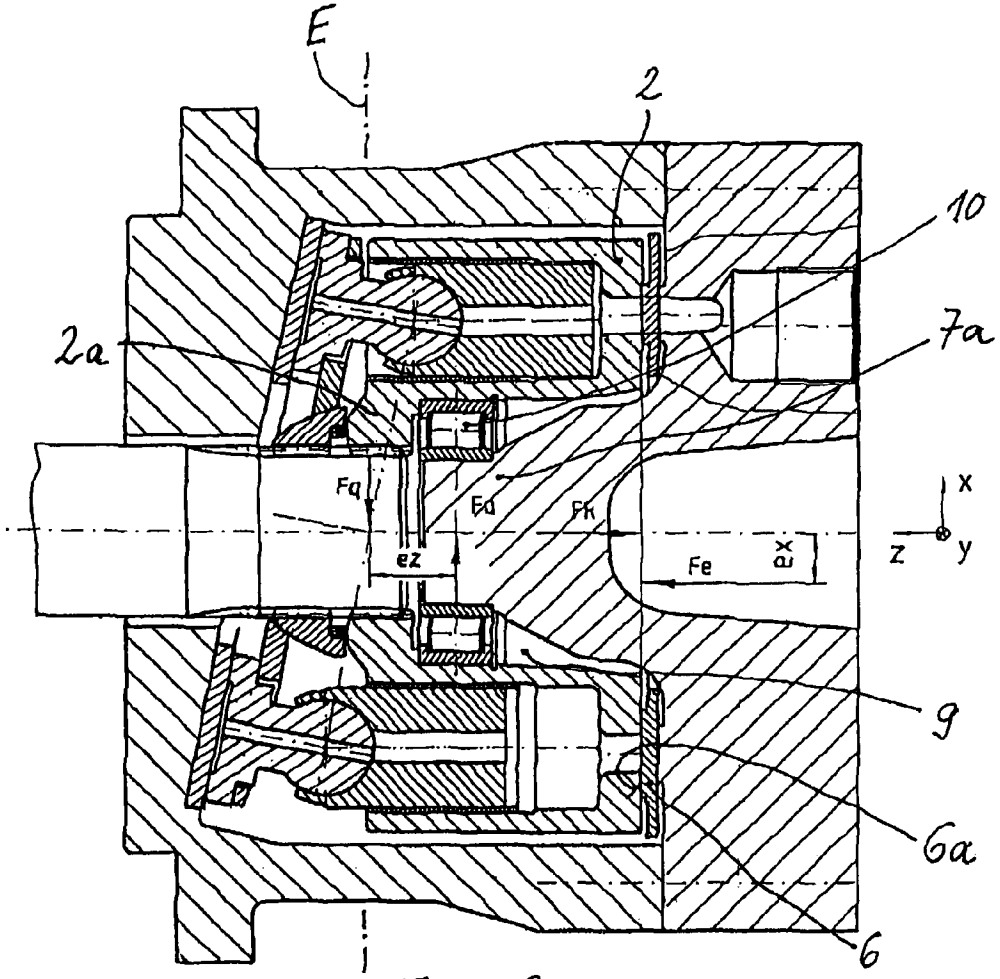
FIG. 2 shows a longitudinal section through a variant of the axial piston machine shown in FIG. 1.

In the embodiment according to FIG. 2, the supporting journal 7*a* is designed to be shorter and the cylinder block bearing 10 is not located in the region of the cylinder block neck 2*a* but is shifted nearer to the valve plate 6*a*. In this case, the cylinder block bearing 10 is arranged axially between a plane E containing the piston outlet openings and the valve plate 6*a*. In this region, there is sufficient space in the recess 9 in order to use a cylinder block bearing 10 which is increased in diameter and, therefore, has a greater loading capacity.

However, this arrangement results in an axial offset (ez) between the resulting piston transverse force (Fq) and the bearing force (Fa) acting in opposition thereto in the cylinder block bearing 10. Due to this axial offset, a tilting moment acts on the cylinder block 2 and attempts to tilt the cylinder block 2 from the valve plate 6*a*.

In order to compensate for this tilting moment, a counter torque is applied which is produced by asymmetrical pressure zones on the valve plate 6*a*. In this case, apertures 11 present for controlling the axial piston machine are provided with cross sections of different size increasing or decreasing over the periphery so that the effective point of the resulting force (Fe) from the hydrostatic valve plate relief is displaced to the effective point of the resulting force (Fk) from the axial cylinder forces in the direction of the dead center (x axis, see FIG. 3) by the amount (ex) and complete or virtually complete compensation for the tilting moment is achieved. In this connection, reference may also be made to the disclosure content of DE 43 40 061 A1, which is herein incorporated by reference.

Figure 4:
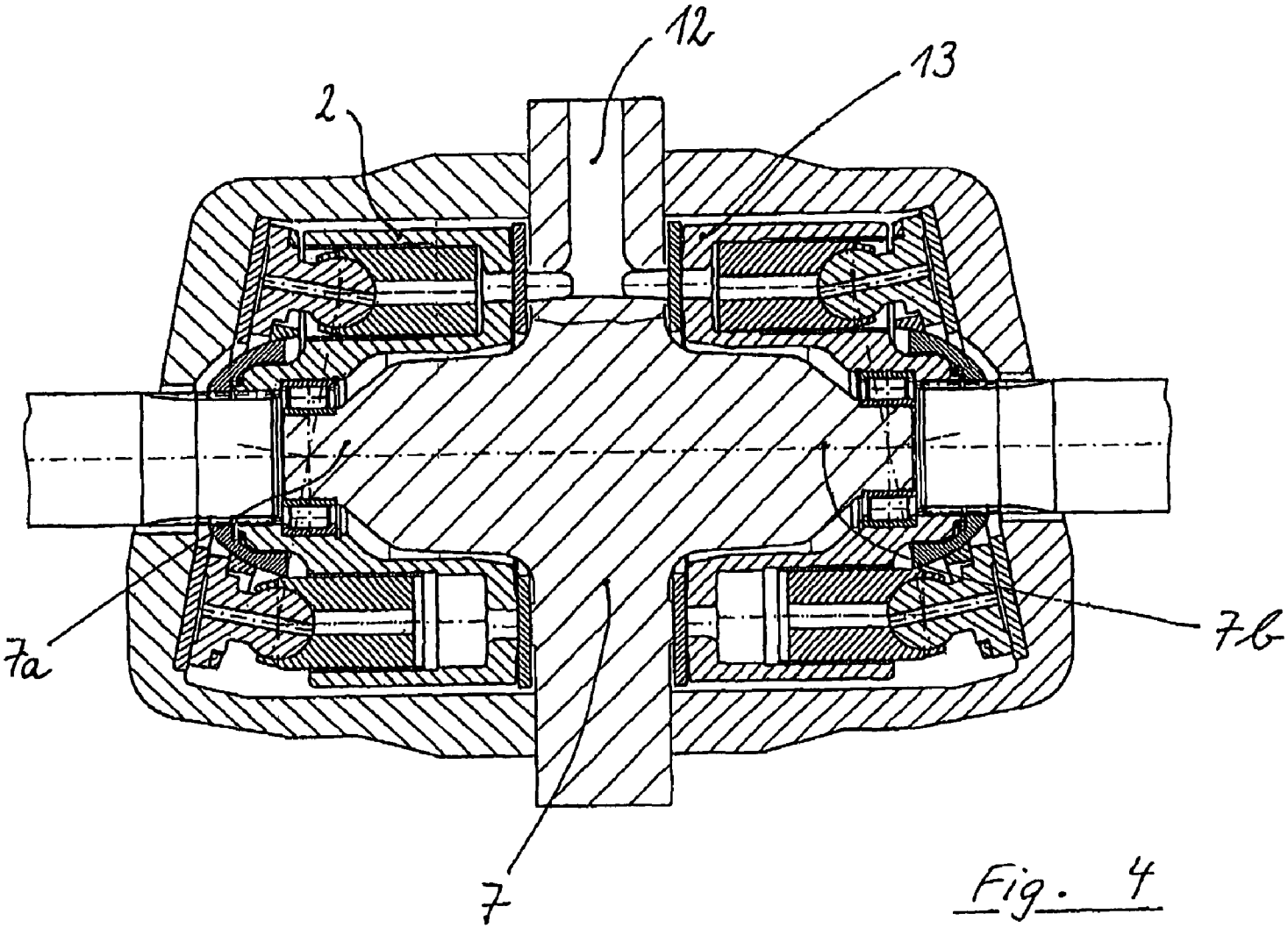
FIG. 4 shows a partial longitudinal section through a driving unit with two axial piston machines according to the invention.

FIG. 4 shows a center section of a driving unit in longitudinal section which includes two axial piston machines according to the invention connected to one another. In this case, the housing component 7 is common to both axial piston machines and contains common supply connections 12, of which one is shown in FIG. 4.

Integrally formed coaxially to the first supporting journal 7*a* on the opposite side of the housing component 7 is a second supporting journal 7*b*, which is coaxial thereto, and carries a cylinder block 13 of the second axial piston machine in the manner already described. This driving unit is suitable, for example, for use in a drive axle of a driven machine.

Figure 5:
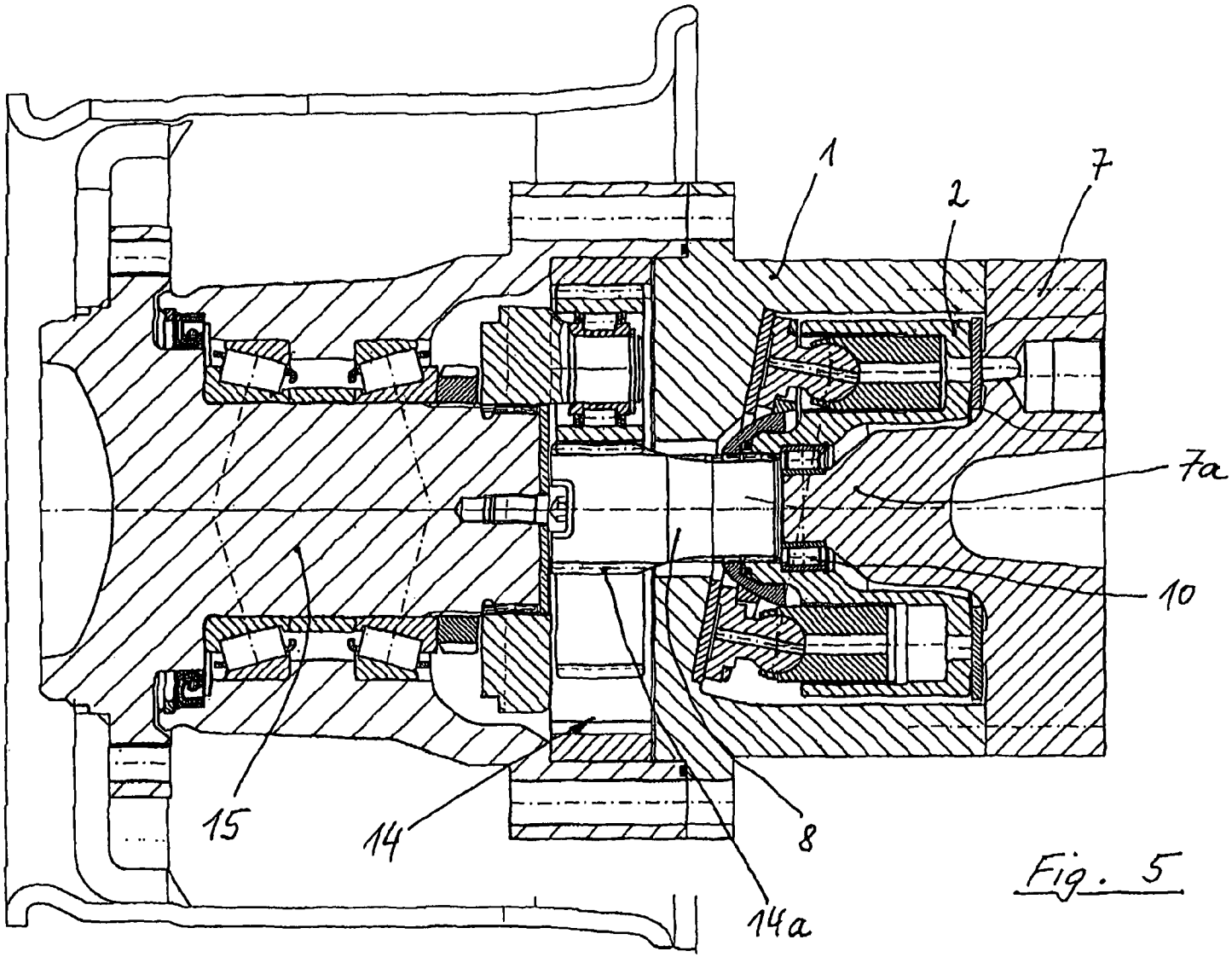
FIG. 5 shows a longitudinal section through a wheel drive with an axial piston machine according to the invention.

Shown in FIG. 5 is an axial piston machine according to the invention which corresponds to the design according to FIG. 1 and is part of a wheel drive. In this case, a sun gear 14*a* of an epicyclic gear unit 14 is integrally formed on the driving shaft 8 designed as a stub shaft, a wheel shaft 15 being driven by this sun gear 14*a*.

Figure 3:
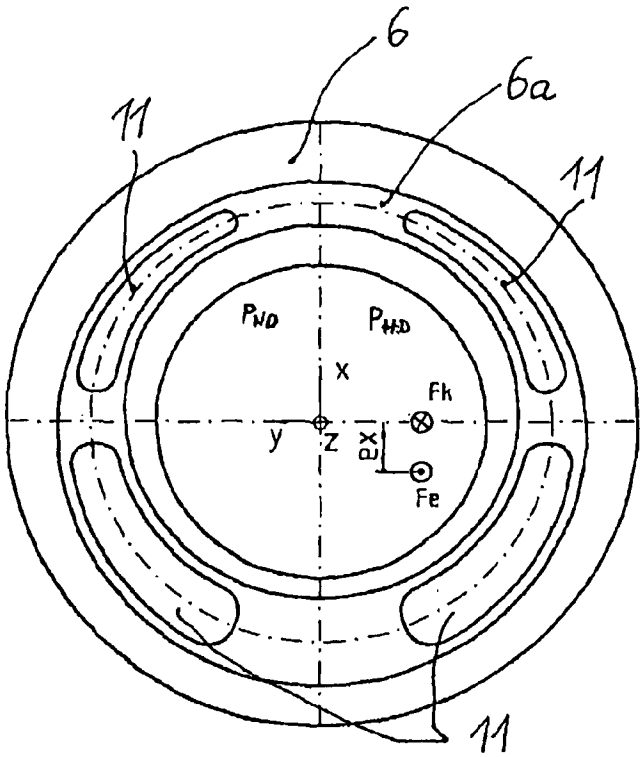
FIG. 3 shows a view of the valve plate of the axial piston machine shown in FIG. 2.
Figure 6:
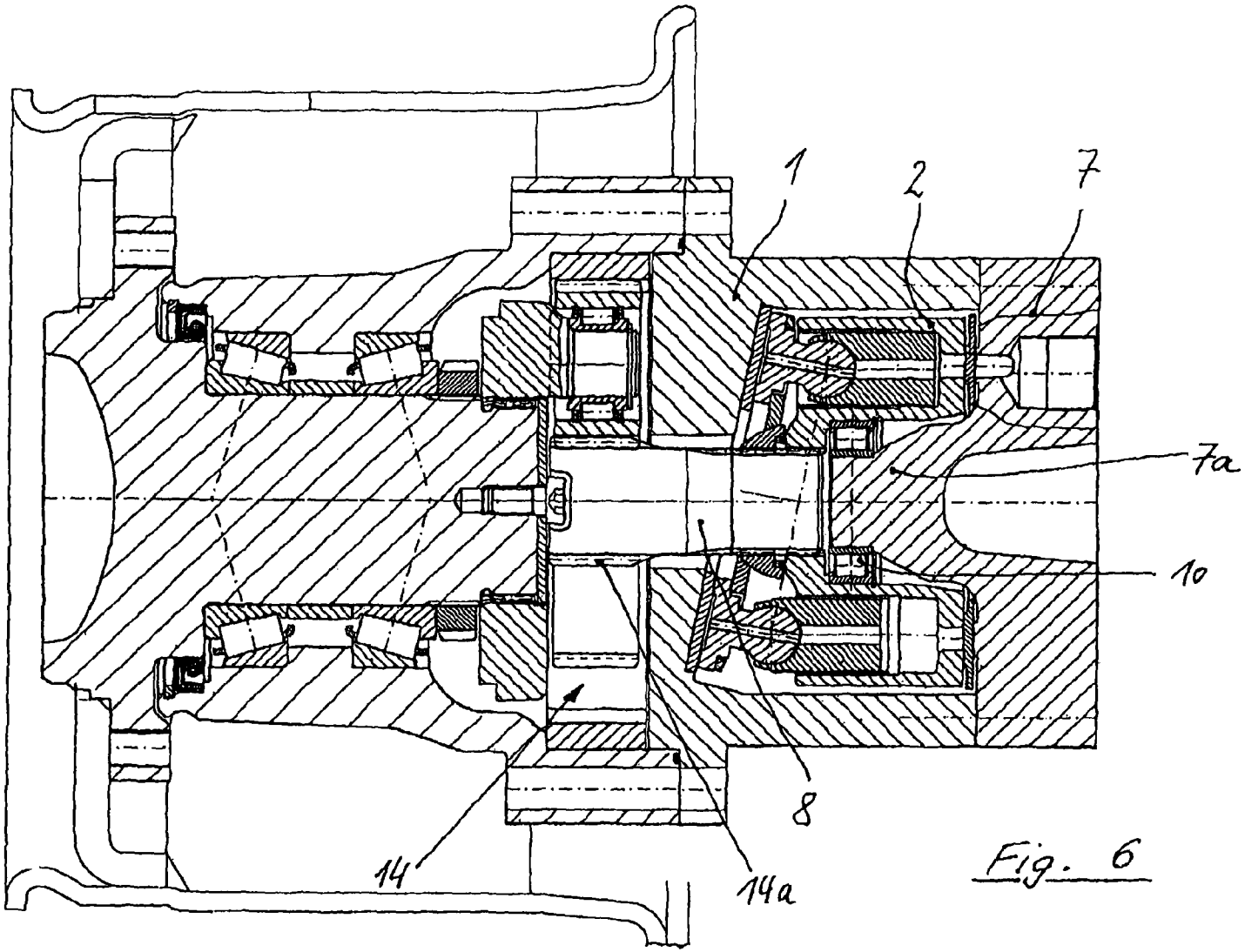
FIG. 6 shows a longitudinal section through a wheel drive with a variant of an axial piston machine according to the invention.

The variant of the wheel drive shown in FIG. 6 differs from the embodiment according to FIG. 5 in that the axial piston machine corresponds to the design according to FIGS. 2 and 3. A feature common to both variants is the compact-type of construction comprising only a relatively few individual items.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An axial piston machine of swash-plate construction, comprising:

a housing having an interior;

a cylinder block rotatable in the housing and comprising a plurality of cylinder bores concentrically formed around a central recess;

a housing component connected to the housing, the housing component comprising a valve plate and a supporting journal, wherein the supporting journal extends into the central recess of the cylinder block, and wherein the cylinder block is supported in an axial direction against the valve plate of the housing component;

a driving shaft having an inner end and coupled in a rotationally synchronous manner to the cylinder block, wherein the driving shaft is coaxial with the supporting journal and wherein the inner end of the driving shaft is adjacent the supporting journal;

a cylinder block bearing configured to absorb transverse forces, wherein the cylinder block bearing is arranged in the central recess of the cylinder block between the cylinder block and the supporting journal and adjacent the inner end of the driving shaft; and pistons supported on a swash plate and longitudinally movable in the cylinder block, wherein the cylinder block bearing is arranged axially between a plane containing the piston outlet openings and the valve plate such that the cylinder block bearing is located entirely between the plane containing the piston outlet openings and the valve plate in the axial direction.

2. The axial piston machine according to claim 1, wherein the supporting journal is integrally formed in one piece on the housing component.

3. The axial piston machine according to claim 1, wherein the cylinder block bearing is a movable bearing.

4. The axial piston machine according to claim 1, wherein an axial offset (ez) is formed between a resulting piston transverse force (Fq) and a bearing force (Fa) acting in opposition thereto in the cylinder block bearing.

5. The axial piston machine according to claim 4, including apertures provided in the valve plate, the apertures configured to build up an asymmetrical pressure zone which acts on the cylinder block and is effective in opposition to a tilting moment produced by the axial offset (ez) between the resulting piston transverse force (Fq) and the bearing force (Fa).

6. The axial piston machine according to claim 1, wherein the driving shaft is a stub shaft, on which a sun gear of an epicyclic gear unit driven by the axial piston machine is arranged or integrally formed.

7. A wheel drive comprising an axial piston machine according to claim 1.

8. The axial piston machine according to claim 3, wherein the cylinder block bearing is a roller bearing.

9. The axial piston machine according to claim 2, wherein an axial offset (ez) is formed between a resulting piston transverse force (Fq) and a bearing force (Fa) acting in opposition thereto in the cylinder block bearing.

10. The axial piston machine according to claim 3, wherein an axial offset (ez) is formed between a resulting piston transverse force (Fq) and a bearing force (Fa) acting in opposition thereto in the cylinder block bearing.

11. The axial piston machine according to claim 9, including apertures provided in the valve plate, the apertures configured to build up an asymmetrical pressure zone which acts on the cylinder block and is effective in opposition to a tilting moment produced by the axial offset (ez) between the resulting piston transverse force (Fq) and the bearing force (Fa).

12. The axial piston machine according to claim 2, wherein the driving shaft is a stub shaft, on which a sun gear of an epicyclic gear unit driven by the axial piston machine is arranged or integrally formed.

13. The axial piston machine according to claim 3, wherein the driving shaft is a stub shaft, on which a sun gear of an epicyclic gear unit driven by the axial piston machine is arranged or integrally formed.

14. The axial piston machine according to claim 4, wherein the driving shaft is a stub shaft, on which a sun gear of an epicyclic gear unit driven by the axial piston machine is arranged or integrally formed.

* * * * *